United States Patent [19]

Davis

[11] Patent Number: 4,673,867

[45] Date of Patent: Jun. 16, 1987

[54] CURRENT MIRROR CIRCUIT AND METHOD FOR PROVIDING ZERO TEMPERATURE COEFFICIENT TRIMMABLE CURRENT RATIOS

[75] Inventor: William F. Davis, Tempe, Ariz.

[73] Assignee: Motorola, Inc., Schaumburg, Ill.

[21] Appl. No.: 879,879

[22] Filed: Jun. 30, 1986

[51] Int. Cl.[4] ..... G05F 3/26

[52] U.S. Cl. ..... 323/315; 323/907

[58] Field of Search ..... 323/315, 316, 907; 330/288

[56] References Cited

U.S. PATENT DOCUMENTS

| | | | |
|---|---|---|---|
| 4,435,678 | 3/1984 | Joseph et al. | 323/273 |
| 4,596,960 | 6/1986 | Hitomi | 323/315 |
| 4,600,965 | 7/1986 | Sato et al. | 323/316 |

FOREIGN PATENT DOCUMENTS

| | | | |
|---|---|---|---|
| 43419 | 3/1984 | Japan | 323/315 |
| 117805 | 6/1985 | Japan | 330/288 |

*Primary Examiner*—William H. Beha, Jr.
*Attorney, Agent, or Firm*—Michael D. Bingham

[57] ABSTRACT

A resistively trimmed current mirror circuit including a diode coupled in parallel to the base-emitter conduction path of a transistor and to which a reference current is supplied to produce a proportional output current at the collector of the transistor. A trimmable resistor is connected in the collector-emitter conduction path of the transistor which is adjusted to vary the output current for a given reference current to trim the ratio between the two currents. By making the reference current a thermal current, i.e., a current whose magnitude is proportional to thermal voltage and inversely proportional to resistance, the trimmed ratio remains temperature independent after being trimmed to a desired value.

13 Claims, 1 Drawing Figure

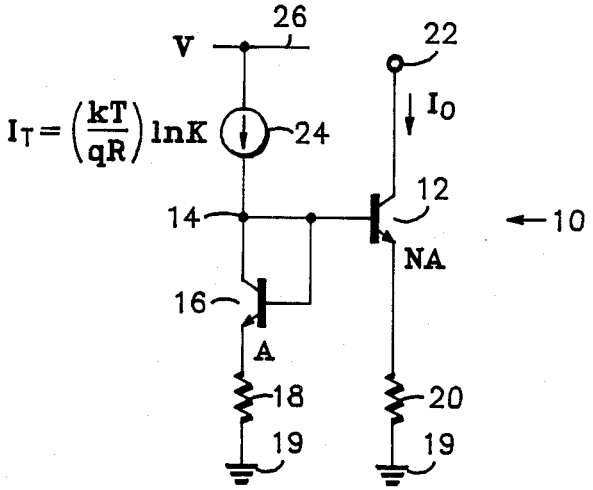
26
V
22
$I_T = \left(\frac{kT}{qR}\right) \ln K$
24
$I_O$
12
14
10
NA
16
A
18
20
19
19

CURRENT MIRROR CIRCUIT AND METHOD FOR PROVIDING ZERO TEMPERATURE COEFFICIENT TRIMMABLE CURRENT RATIOS

BACKGROUND OF THE INVENTION

This invention relates to current sources and, more particularly, to a current mirror circuit arrangement for providing an output current that is proportional to an input current supplied to the current mirror circuit and which the ratio of the two currents is both trimmable and temperature independent.

Monolithic integrated current mirror circuits are well known to those skilled in the art. A simple current mirror circuit that is known includes an output transistor whose collector provides the output current and whose emitter is returned to a reference potential and a diode whose anode-cathode is connected in parallel with the base-emitter junction of the transistor. The input current is supplied to the anode of the diode. The diode is typically formed by an additional transistor which has its collector interconnected to both its base and the base of the output transistor. The ratio of the output current $I_O$ to the input current $I_T$ can be set to a desired value by area ratioing the emitters of the two transistors as is understood.

It is sometimes desirable to trim the two currents to a desired ratio while maintaining the trimmed ratio independent of temperature variations. One method to trim the current ratio in the above described current mirror circuit is to trim the emitter areas of the two transistors with respect to one another. Although emitter area trimming results in a ratio that is independent of temperature, it is not a practical method to be used.

Another method for adjusting the current ratio of the current mirror circuit is to provide resistive trimming using trimmable resistors coupled respectively between ground reference and the diode as well as the emitter of the output transistor. By trimming one or the other or both resistors, the value of $I_O$ can be adjusted with respect to a given input current $I_T$. However, the current density of the output transistor is changed relative to that of the diode-connected transistor as one or the other resistor is trimmed. This produces a current ratio having some temperature coefficient (TC) other than zero which may not be desirable.

Hence, a need exists for a method for providing trimmable current ratios in such current mirror circuits wherein the adjusted ratio is independent to temperature variations, i.e., a zero TC.

SUMMARY OF THE INVENTION

Accordingly, it is an object of the present invention to provide an improved current mirror circuit.

It is another object of the invention to provide a method for use with a current mirror circuit of provide trimmable zero TC current ratios.

Yet another object of the present is to provide an integrated current mirror circuit in which the current ratio is trimmable and independent of temperature.

In accordance with the above and other objects there is provided a current mirror circuit comprising two parallel circuit paths including a diode connected in the first circuit path and a transistor having its collector-emitter connected in the second circuit path and its base coupled to the diode and a current supply providing a thermal current to the diode. The current mirror circuit includes trimmable resistive elements in one or the other or both of the circuit paths the value of which may be trimmed to change the ratio of the currents flowing in the two circuit paths wherein the resulting ratio is both a constant and temperature independent.

BRIEF DESCRIPTION OF THE DRAWING

The single FIGURE is a schematic diagram of the current mirror circuit of the present invention.

DETAILED DESCRIPTION OF THE PREFERRED EMBODIMENT

Referring now to the sole FIGURE there is illustrated current mirror circuit 10 of the preferred embodiment. Current mirror circuit 10 includes NPN transistor 12 whose base or control electrode is coupled at circuit node 14 to diode 16. Diode 16, which as understood, may be formed by a NPN transistor having its collector shorted to its base is coupled between node 14 and common terminal 19 via resistor 18 in a first current circuit path to earth reference potential. The emitter or first main electrode of transistor 12 is connected via resistor 20 to common terminal 19 while the collector or second main electrode of transistor 12 is coupled to output node 22. The collector-emitter conduction path of transistor 12 comprises a second current circuit path and provides an output current $I_O$ therefrom. It is understood that output node 22 is connected to some load utilization means. A current supply 24 coupled between a power supply conductor 26 and node 14 sources a reference input current to node 14 to forward bias diode 16.

As so far described, current mirror 10 is conventional in structure and operation. Without considering resistors 18 and 20, as diode 16 is forward biased the current $I_T$ flows therethrough and transistor 12 is rendered conductive to provide the collector current $I_O$. $I_O$ is proportional to $I_T$ depending on the ratio of the emitter areas of the two transistors. For example, if the emitter area of transistor 12 is made N times the emitter area of diode-connected transistor 16, where N is any positive number, $I_O$ will be approximately equal to $NI_T$.

As previously mentioned, it is often desirable to trim the two currents $I_O$ and $I_T$ to a desired ratio while maintaining the ratio independent of temperature. Trimmable resistors 18 and 20 provide a convenient means for adjusting this ratio. For instance, by trimming resistor 20 the value of $I_O$ is adjusted for a given $I_T$. There are many known methods for trimming these resistors. If, for instance, current mirror circuit 10 is fabricated in integrated circuit form, resistors 18 and 20 may be thin film metal resistors the value of which can be adjusted by laser trim techniques familiar to those skilled in the art. As the value of resistor 20 is trimmed, for example, the value of $I_O$ is adjusted for a given $I_T$ which sets the desired ratio of the two currents. Although the described trim technique has been used in the past the resultant trimmed ratio is not constant with temperature due to the fact that the current density of transistor 20 is changed relative to that of diode 16.

As will be described hereinafter in detail, it was discovered that the ratio of the two currents could be adjusted and still have a zero TC by making current reference $I_T$ a thermal current, i.e., a current of the form:

$$I_T=(kT/qR)\ln K \quad (1)$$

where:
k is Boltzmann's constant
q is the charge of an electron
R is a resistance of a given resistivity and TC;
T is absolute temperature; and
K is a constant.

Prior art current sources providing thermal currents of the above described form are well known. For example, U.S. Pat. No. 4,435,678 discloses such a current source.

If $I_T$ is a thermal current of the form of equation 1, it can be shown the ratio of $I_O$ to $I_T$ is a constant and can be adjusted by trimming either resistor 18 or 20 such that the resultant ratio is independent of temperature. Thus, with the current of equation 1 supplied to current mirror circuit 10, the following current mirror ratio can be expressed:

$$I_T/I_O=(R2/R)\ln KI/\ln[(I_T/I_O)NK^{(R1/R)}] \quad (2)$$

where:
R2 is the resistance of resistor 20
R1 is the resistance of resistor 18; and
R, R1, and R2 are all of the same resistivity material and have the same TC.

Because (R2/R)ln K is always a constant, C1, and $NK^{(R1/R)}$ is always a constant, C2. Then:

$$(I_T/I_O)\ln[C2(I_T/I_O)]=C1 \quad (3)$$

Since, the ratio of $I_T$ to $I_O$ must be a constant to satisfy equations 2 and 3, the ratio must then be independent of temperature.

The current ratio $I_T/I_O$ or its inverse can be trimmed by adjusting R, N, R1, R2 or K and still remain temperature independent. However, in practice, R1 and R2 are most conveniently trimmed to adjust the current ratio.

It is further understood that multiple current ratios can be provided by using multiple transistors connected to node 14 in the similar fashion as transistor 12, i.e., having their bases connected to node 14 and the collector-emitter conduction paths coupled in series with a trimmable resistor to common terminal 19.

Hence, what has been described is a method of providing resistive trimming in a current mirror circuit to adjust the ratio of output current to the input current thereof while maintaining the ratio independent of temperature by driving the current mirror circuit with a thermal current.

What is claimed is:

1. Circuit for providing an output current that is proportional to an applied input current and having first and second current paths, comprising:

current supply means for supplying a thermal current to the first current path, said thermal current having the form of (kT/qR)ln K, where k is Boltzmann's constant, q is the charge of an electron, R is a resistance of a given resistivity and temperature coefficient, T is absolute temperature and K is a constant;

diode means coupled in the first current path through which substantially all of said thermal current flows;

a first transistor the base-emitter junction of which is coupled in a parallel conduction path with respect to said diode means and the collector-emitter junction being coupled in the second current path such that the output current flows therethrough; and trimmable resistive means having substantially the same temperature coefficient as said resistance R for adjusting the ratio of the thermal current to said output current with said adjusted ratio being both constant and temperature independent.

2. The circuit of claim 1 wherein said diode means is a second transistor having a collector, an emitter and a base with said collector and base being shorted to said base of said first transistor and receiving said thermal current.

3. The circuit of claim 2 wherein said trimmable resistive means is a resistor connected between said emitter of said first transistor and a terminal to which is supplied ground reference potential.

4. The circuit of claim 2 wherein said trimmable resistive means is a resistor connected between said emitter of said second transistor and a terminal to which is supplied a ground reference potential.

5. The circuit of claim 2 wherein said trimmable resistive means includes;

a first resistor connected between said emitter of said first transistor and a terminal to which is supplied ground reference potential; and a second resistor connected between said emitter of said second transistor and said terminal.

6. A current mirror circuit for providing an output current the magnitude of which is proportional to the magnitude of a supplied reference current, comprising:

current source means for supplying a thermal reference current, said thermal reference current having the form of (kT/qR)ln K, where k is Boltzmann's constant, q is the charge of an electron, R is a resistance of a given resistivity and temperature coefficient, T is absolute temperature and K is a constant;

diode means which is forward biased by said thermal reference current;

a first transistor having a control electrode coupled to said diode means and first and second electrodes, said transistor providing said output current at said second electrode thereof; and trimmable resistive means having substantially the same temperature coefficient as said resistance R coupled in series between said first electrode of said first transistor and a common terminal for adjusting the magnitude of the output current for a given thermal reference current wherein the adjusted ratio of the two currents is substantially temperature independent.

7. The current mirror circuit of claim 6 wherein said diode means is a second transistor having first, second and control electrodes, said control and second electrodes being interconnected to said control electrode of said first transistor and receiving said thermal reference current.

8. The current mirror circuit of claim 7 including resistive means coupled in series between said first electrode of said second transistor and said common terminal.

9. A method for adjusting the ratio of the output current to the input reference current of a current mirror circuit while maintaining the adjusted ratio substantially temperature independent, the current mirror circuit including a transistor for providing the output current at a first electrode thereof, a diode coupled in a parallel conduction path to the control-second electrode conduction path of the transistor and receiving the input reference current, and trimmable resistive means for adjusting the ratio of the reference current to the output current, comprising the steps of:

providing an input reference current having a magnitude that varies directly with absolute temperature multiplied by a constant factor and inversely to the resistance of a resistor of a given resistivity and temperature coefficient; and adjusting the resistance of the trimmable resistive means, said resistive means having the same temperature coefficient as said resistor.

10. A current mirror arrangement including at least first and second current circuit paths, comprising:

current supply means for providing a thermal current at an output thereof of the form, (kT/qR) ln K, where k is Boltzmann's constant, T is absolute temperature, q is the charge of an electron, R is the resistance of a given resistivity and temperature coefficient and K is a constant;

the first current circuit path including semiconductor diode means coupled to said current supply means through which substantially all of said thermal current flows;

the second current circuit path including the collector-emitter conduction path of a first transistor the base of which is coupled to said current supply means; and trimmable resistive means having the same temperature coefficient as said resistance for adjusting the ratio of the currents in the first and second current circuit paths with respect to one another wherein said adjusted ratio is both constant and temperature independent.

11. The current mirror of claim 10 wherein said trimmable resistive means includes:

a first resistor coupled between said diode means and a common terminal, the resistance of said first resistor being trimmable and having substantially the same temperature coefficient as said resistance of given resistivity; and a second resistor coupled between the emitter of said first transistor and said common terminal, the resistance of said second resistor being trimmable and having substantially the same temperature coefficient as said first resistor.

12. The current mirror of claim 10 wherein:

said trimmable resistive means includes a resistor coupled between the emitter of said first transistor and a common terminal; and said semiconductor diode means is coupled between said output of said current supply means and said common terminal.

13. The current mirror of claim 10 wherein said trimmable resistive means includes:

a resistor coupled between said semiconductor diode means and a common terminal, the resistance of said resistor being trimmable; and means for connecting the emitter of said first transistor to said common terminal.

* * * * *

UNITED STATES PATENT AND TRADEMARK OFFICE

CERTIFICATE OF CORRECTION

PATENT NO. : 4,673,867

DATED : June 16, 1987

INVENTOR(S) : William F. Davis

It is certified that error appears in the above-identified patent and that said Letters Patent is hereby corrected as shown below:

Claim 10, column 5, line 29 add -- flowing -- after currents.

Signed and Sealed this

Thirtieth Day of August, 1988

*Attest:*

DONALD J. QUIGG

*Attesting Officer*

*Commissioner of Patents and Trademarks*